US007798463B2

(12) United States Patent
Morgenroth

(10) Patent No.: US 7,798,463 B2
(45) Date of Patent: Sep. 21, 2010

(54) ADJUSTABLE HANGING DEVICE

(75) Inventor: James A. Morgenroth, Racine, WI (US)

(73) Assignee: Adjustable Picture Hook, LLC, Racine, WI (US)

( * ) Notice: Subject to any disclaimer, the term of this patent is extended or adjusted under 35 U.S.C. 154(b) by 0 days.

(21) Appl. No.: 12/351,057

(22) Filed: Jan. 9, 2009

(65) Prior Publication Data

US 2009/0206213 A1 Aug. 20, 2009

Related U.S. Application Data

(60) Provisional application No. 61/062,722, filed on Jan. 29, 2008.

(51) Int. Cl.
*A47F 7/14* (2006.01)

(52) U.S. Cl. ..... 248/475.1; 211/106.01; 248/304; 248/480

(58) Field of Classification Search ..... 248/475.1, 248/476, 480, 220.31, 220.41, 220.42, 304; 211/87.01, 106.01, 57.1, 59.1
See application file for complete search history.

(56) References Cited

U.S. PATENT DOCUMENTS

| | | | | |
|---|---|---|---|---|
| 4,678,151 | A * | 7/1987 | Radek | 248/223.41 |
| 5,503,277 | A * | 4/1996 | O'Brien | 211/106.01 |
| 6,050,426 | A * | 4/2000 | Leurdijk | 211/94.01 |
| 6,119,878 | A * | 9/2000 | Zen | 211/94.01 |
| D479,981 | S * | 9/2003 | Snell | D8/372 |
| 6,772,890 | B2 * | 8/2004 | Campbell et al. | 211/94.01 |
| 6,935,518 | B2 * | 8/2005 | Winig et al. | 211/90.02 |
| 2005/0006539 | A1 * | 1/2005 | Fischer et al. | 248/220.42 |
| 2008/0179474 | A1 * | 7/2008 | Johnson | 248/214 |
| 2008/0257841 | A1 * | 10/2008 | Abernathy | 211/87.01 |

* cited by examiner

*Primary Examiner*—Ramon O Ramirez
(74) *Attorney, Agent, or Firm*—Michael Best & Friedrich LLP

(57) ABSTRACT

The present invention provides, among other things, an adjustable hanging device for securing an object to a wall including a frame defining a number of substantially parallel slots and being securable to a wall, and a hook for supporting an object and being selectively moveable along each of the plurality of slots in a sliding direction to adjust an orientation of the object relative to the wall. Each of the slots can have a closed end to prevent the hook from disengaging the frame while moving in the sliding direction.

6 Claims, 11 Drawing Sheets

ADJUSTABLE HANGING DEVICE

CROSS-REFERENCE TO RELATED APPLICATIONS

This applications claims priority to U.S. Provisional Patent Application No. 61/062,722, filed on Jan. 29, 2008, the contents of which is hereby incorporated by reference.

FIELD OF THE INVENTION

The present invention relates to a device for hanging an object, such as a picture frame, from a support surface, such as a wall such that the object is adjustable relative to the support surface.

SUMMARY

In some embodiments, the present invention provides an adjustable hanging device for securing an object to a wall including a frame defining a number of substantially parallel slots and being securable to a wall, and a hook for supporting an object and being selectively moveable along each of the slots in a sliding direction to adjust an orientation of the object relative to the wall. Each of the slots can have a closed end to prevent the hook from disengaging the frame while moving in the sliding direction.

DETAILED DESCRIPTION

Figure 1:
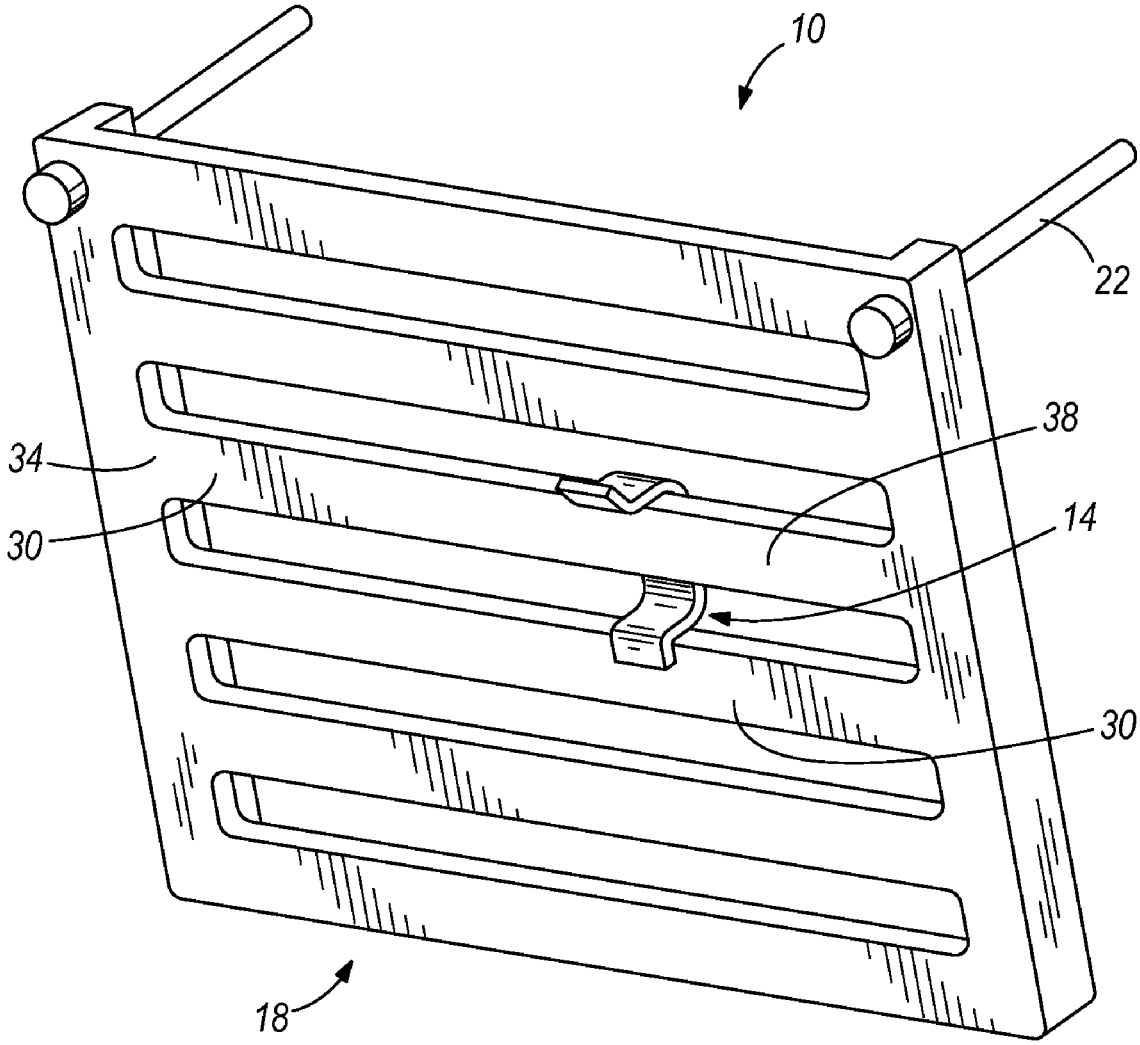
FIG. 1 is a perspective view of an adjustable hanging device according to an embodiment of the invention.

FIGS. 1-4 illustrate an adjustable hanging device 10 according to an embodiment of the invention. The adjustable hanging device 10 can be used to enable adjustments to a picture frame, group of picture frames, or other object(s) being hung on a support surface. The object to be hung is carried on a hook member 14 that is attachable to a grid member or "cleat" 18. The grid member 18 can be mounted to a support surface, such as a wall, using fasteners 22 (e.g., nails, screws, etc.) that pass through holes 26 provided in the upper corners of the grid member 18.

Once the grid member 18 is mounted to the support surface, the hook member 14 carrying the object may be adjustably positioned on the grid member 18. The hook member 14 is positioned on one of several vertically-spaced tracks 30 of the grid member 18. The hook member 14 hangs on the given track 30 and is additionally braced by the next lower track 30. Once positioned on one of the tracks 30, the hook member 14 is also horizontally adjustable along the track 30 between two opposite ends 34, 38 of the given track 30. Once in a desired position, both vertically and horizontally on the grid member 18, the hook member 14 (and the picture frame or other object) can easily be reoriented with respect to the support structure without removing or replacing the grid member 18. This process can be repeated with additional hook members 14 and objects on the same grid member 18 or an additional grid member 18 to create a vertically and horizontally adjustable array of objects, which can be re-aligned, interchanged, or adjusted horizontally and vertically in any desirable way without remounting the grid member(s) 18 on the support surface, without modifying any part of the object, the hook member 14, or the grid member 18, and without adding any additional components to the object or the hanging device 10.

In order to mount a picture frame or other object in a specific location on a support surface (e.g., wall), no precise measurements are needed. As long as the grid member 18 is mounted such that it encompasses the specific location on the support surface, the hook member 14 and the object to be hung can be adjusted to the specific location. The grid member 18 and hook member 14 provide numerous adjustment possibilities, resulting in precise alignment.

No changes or additions of hardware need to be made to the object to be hung. Instead, the object simply hangs by the hook member 14, which is mobile between different tracks 30 and along each of the tracks 30 of the grid member 18.

The hook member 14 and the entire hanging device 10, is compatible with standard wire, saw-tooth, and cardboard notch systems commonly found on picture frames.

Figure 2:
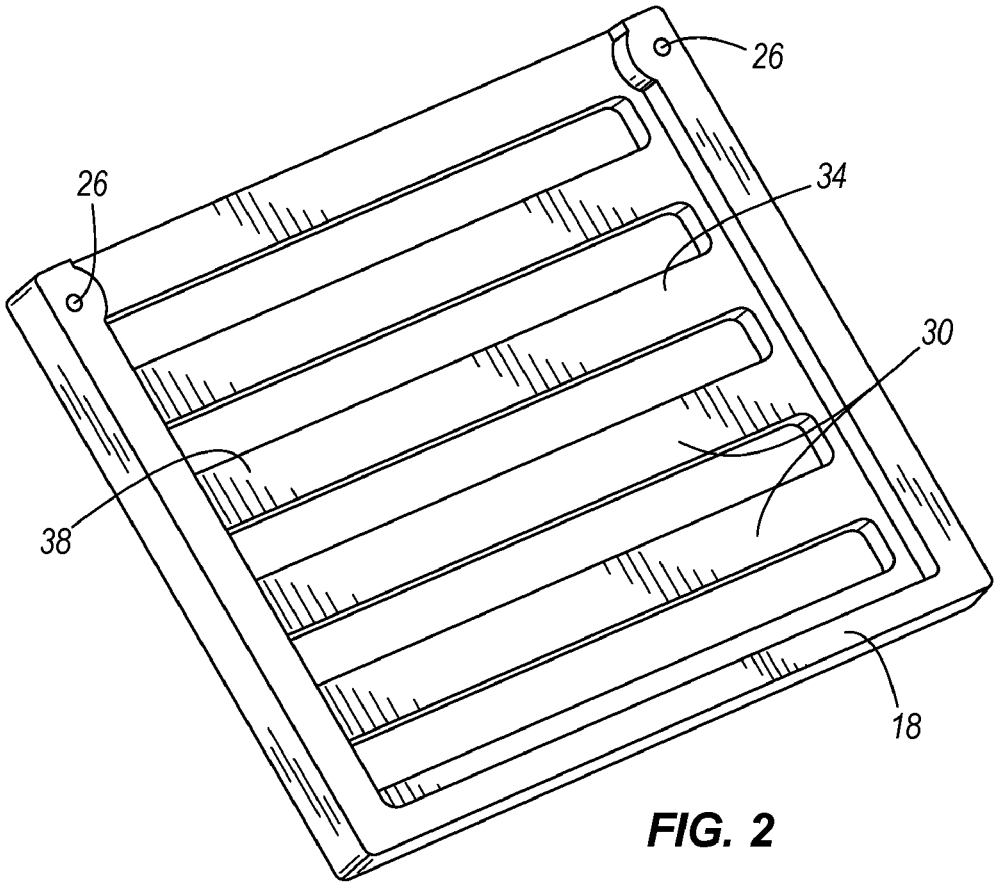
FIG. 2 is a perspective view of a grid member of the adjustable hanging device of FIG. 1.
Figure 3:
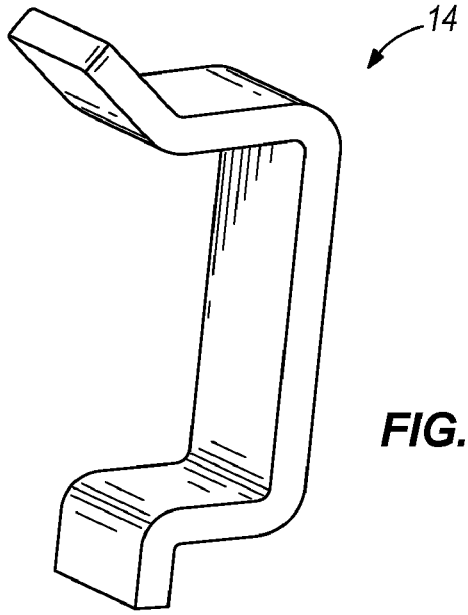
FIG. 3 is a perspective view of a hook member of the adjustable hanging device of FIG. 1.
Figure 4:
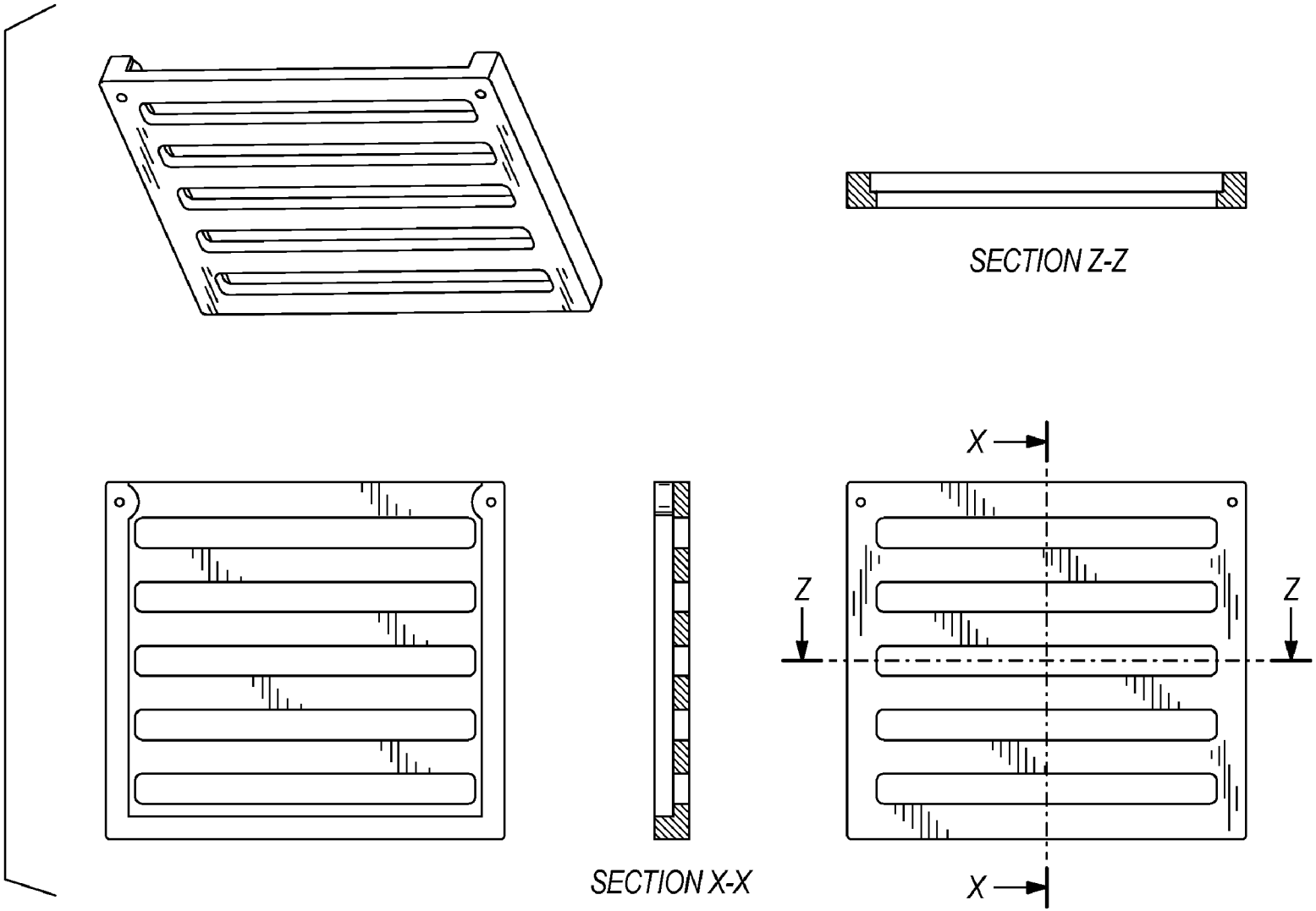
FIG. 4 is a set of engineering drawings, including section views, of the grid member shown in FIG. 2.
Figure 5:
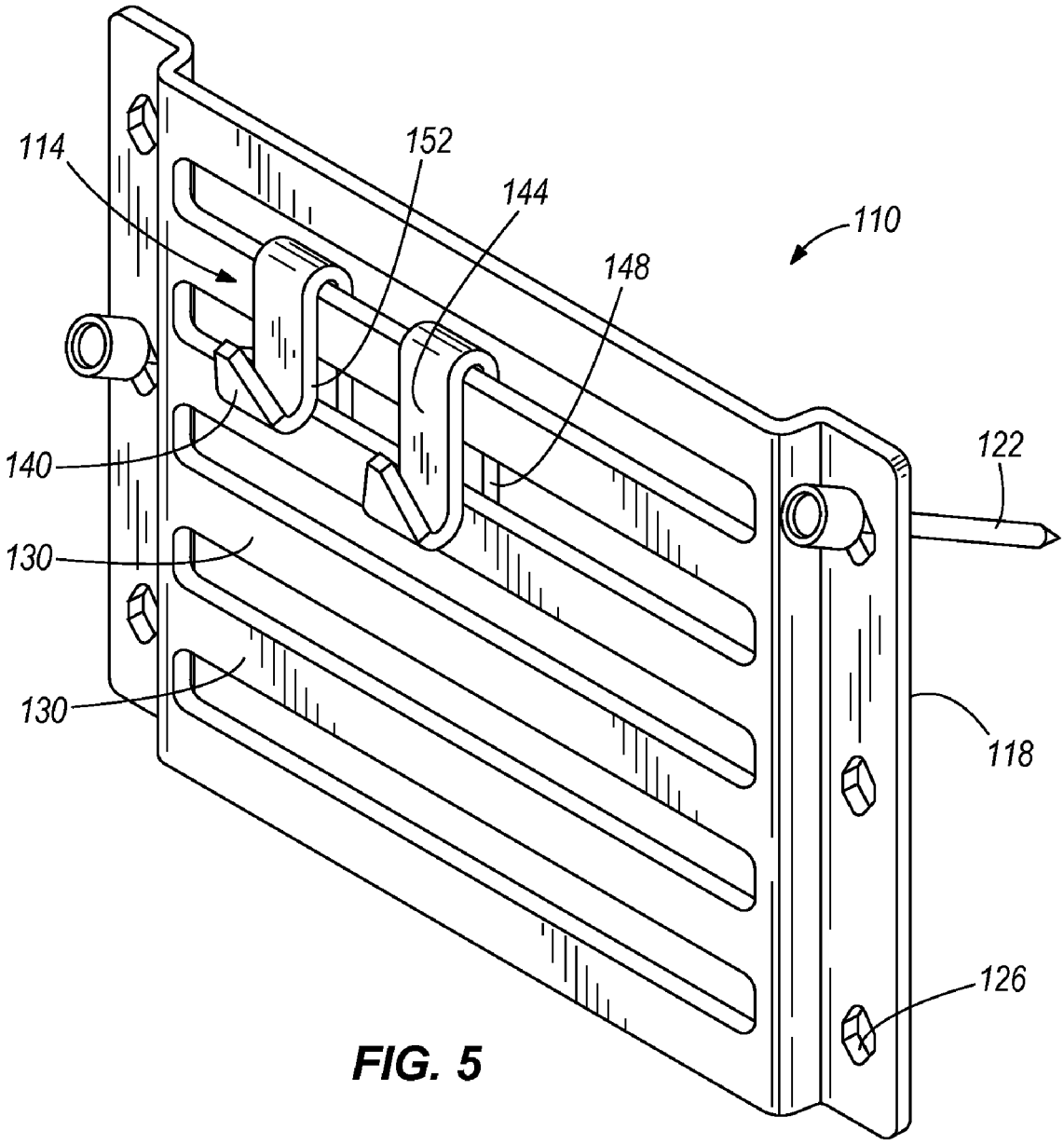
FIG. 5 is a perspective view of an adjustable hanging device according to another embodiment of the invention.
Figure 6:
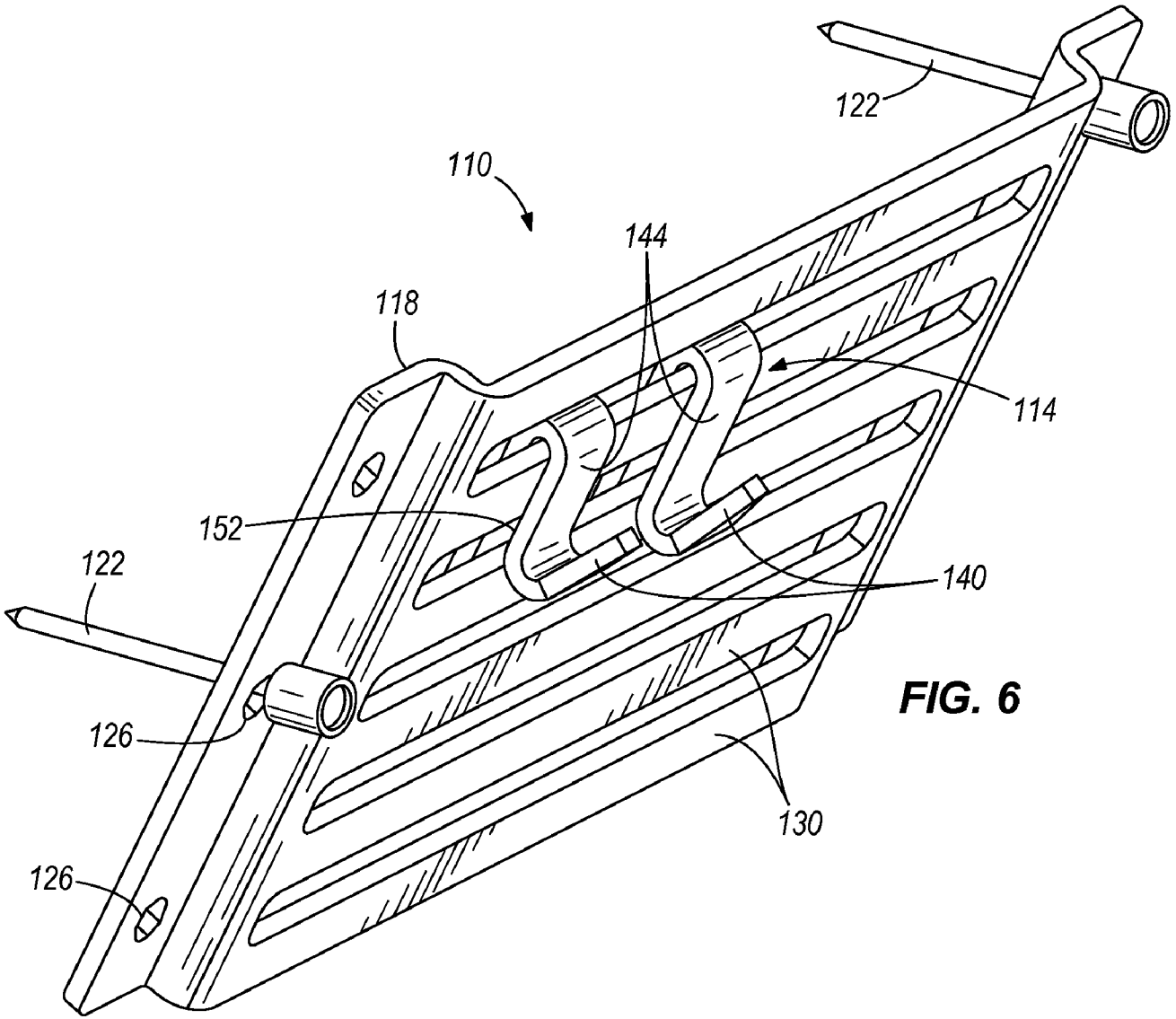
FIG. 6 is an angled view of the adjustable hanging device of FIG. 5.
Figure 7:
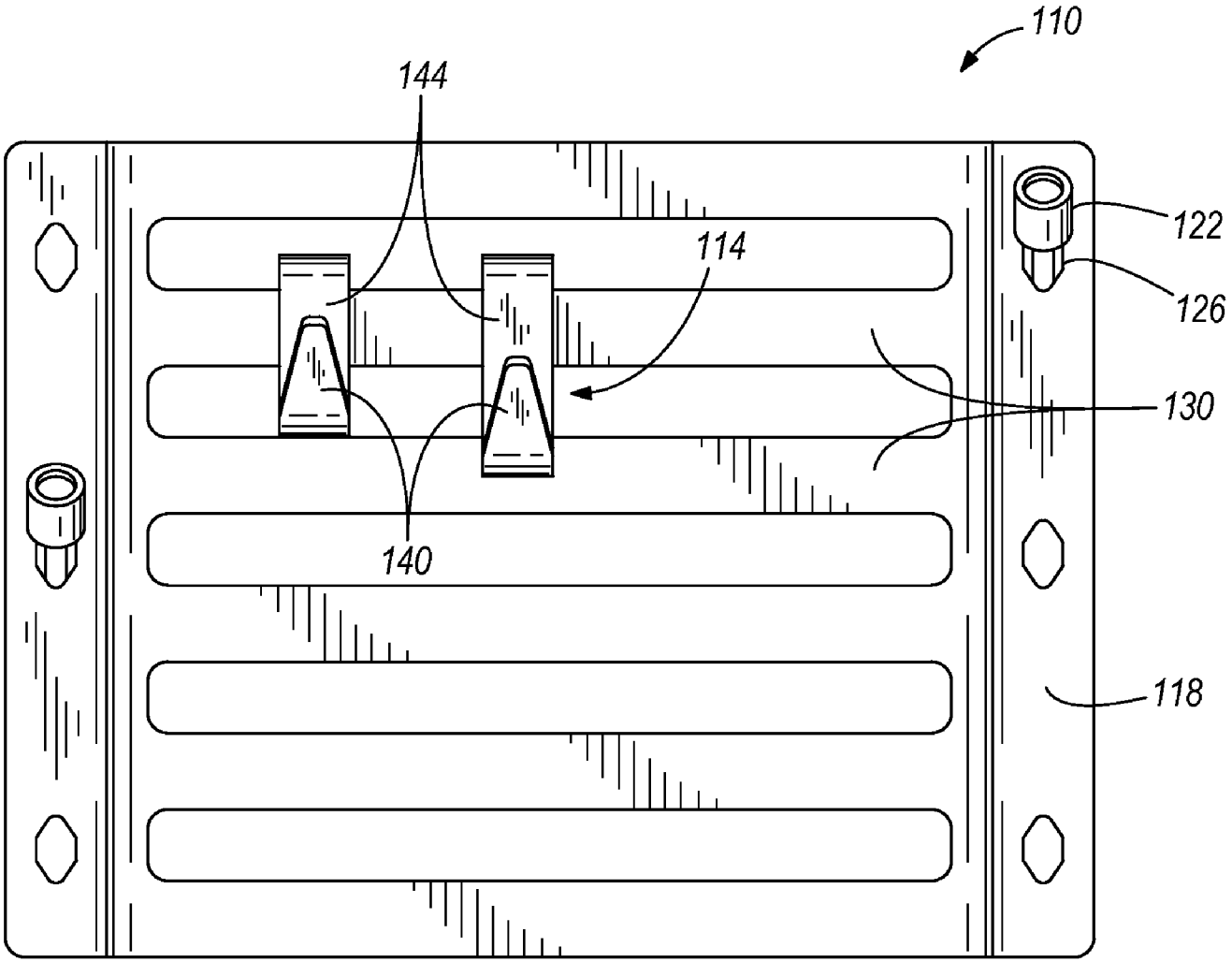
FIG. 7 is a front view of the adjustable hanging device of FIG. 5.
Figure 8:
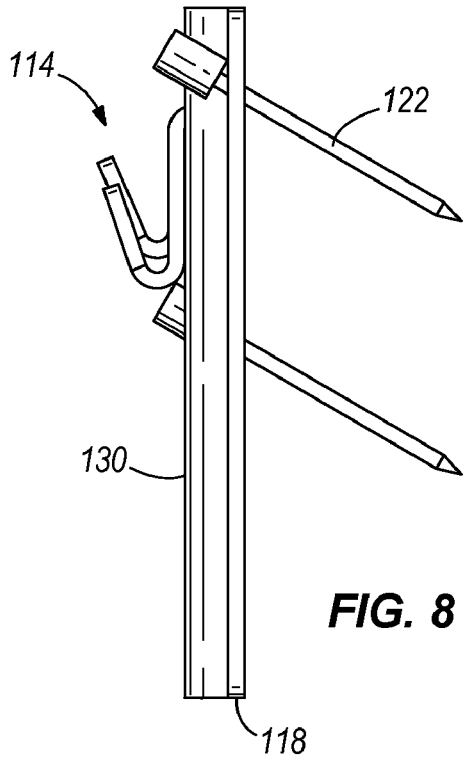
FIG. 8 is a side view of the adjustable hanging device of FIG. 5.

FIGS. 5-9 illustrate an adjustable hanging device 110 according to another embodiment of the invention. The adjustable hanging device 110 shown in FIGS. 5-9 is similar in many ways to the illustrated embodiment of FIGS. 1-4 described above. Accordingly, with the exception of mutually inconsistent features and elements between the embodiment of FIGS. 1-4 and the embodiment of FIGS. 5-9, reference is hereby made to the description above accompanying the embodiment of FIGS. 1-4 for a more complete description of the features and elements (and the alternatives to the features and elements) of the embodiment of FIGS. 1-4. Features and elements in the embodiments of FIGS. 5-9 corresponding to features and elements in the embodiment of FIGS. 1-2 are numbered in the 100 series.

Figure 9:
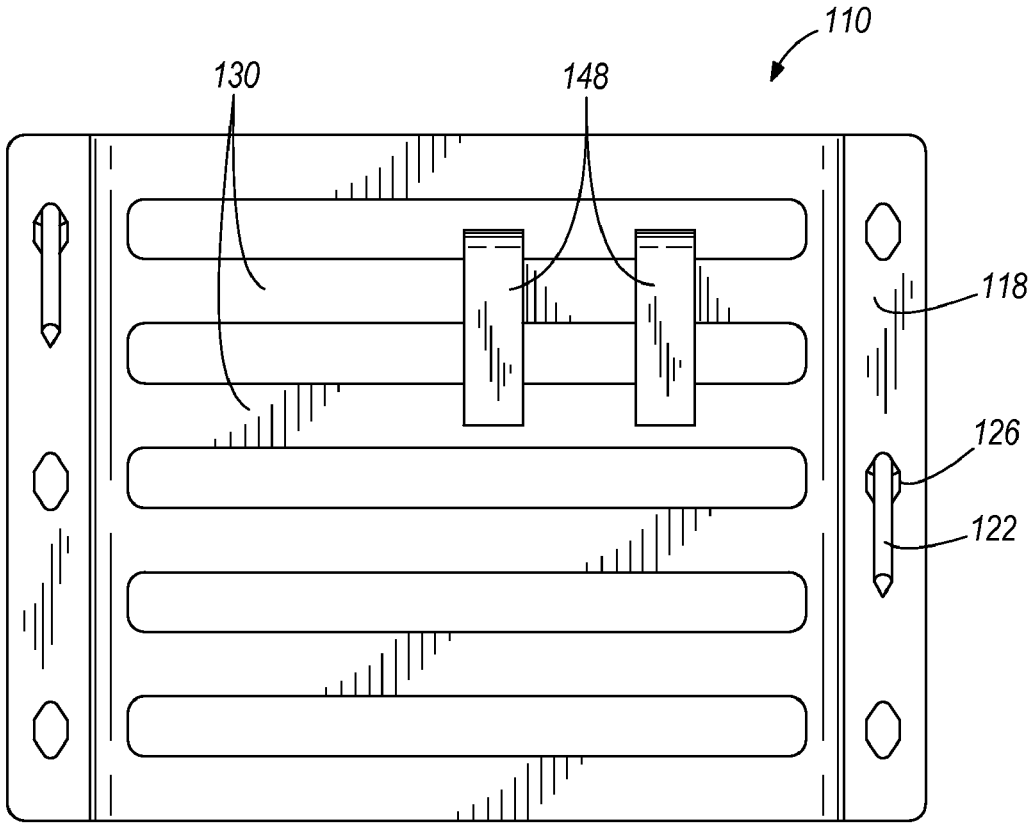
FIG. 9 is a rear view of the adjustable hanging device of FIG. 5.
Figure 10:
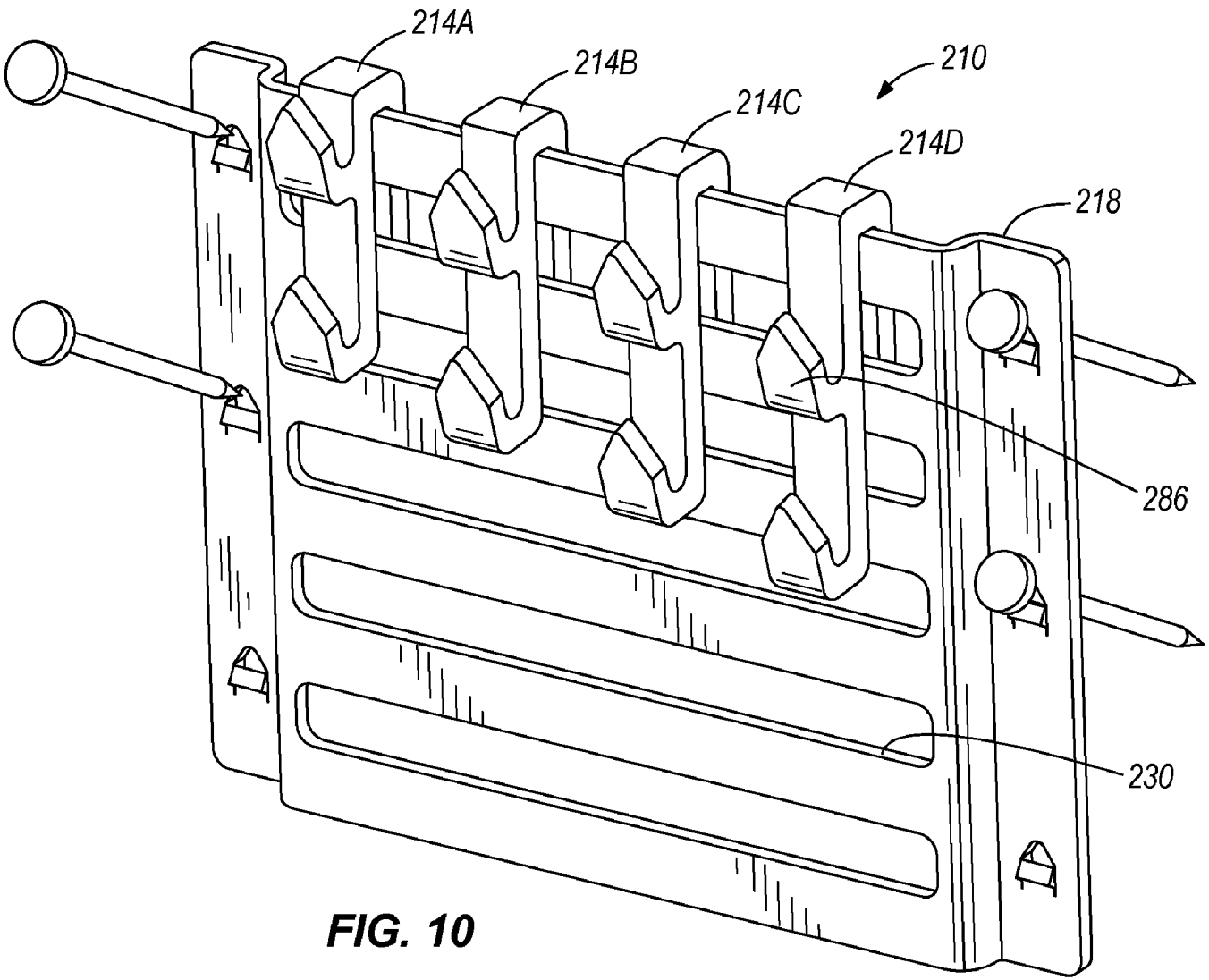
FIG. 10 is a perspective view of an adjustable hanging device according to another embodiment of the present invention.
Figure 11:
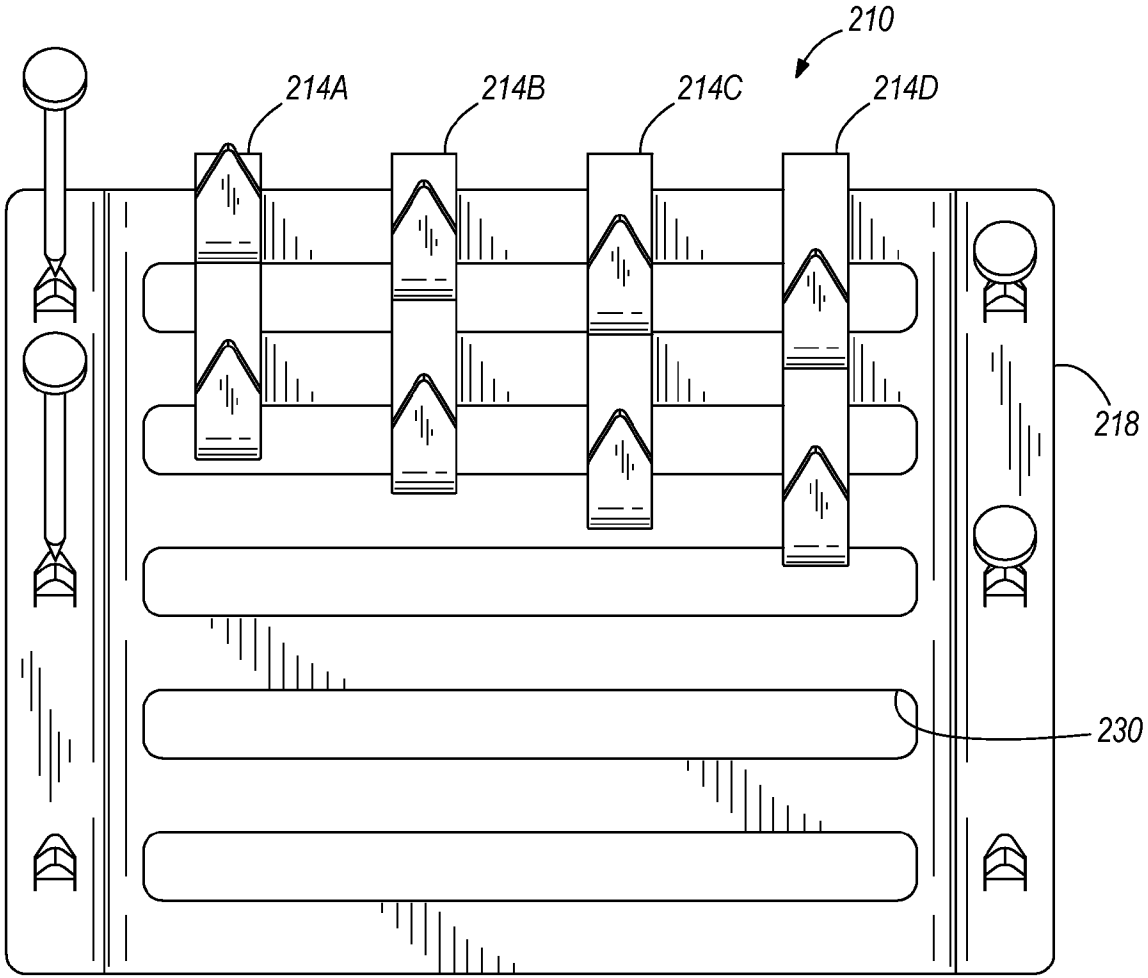
FIG. 11 is a front view of the adjustable hanging device of FIG. 10.
Figure 12:
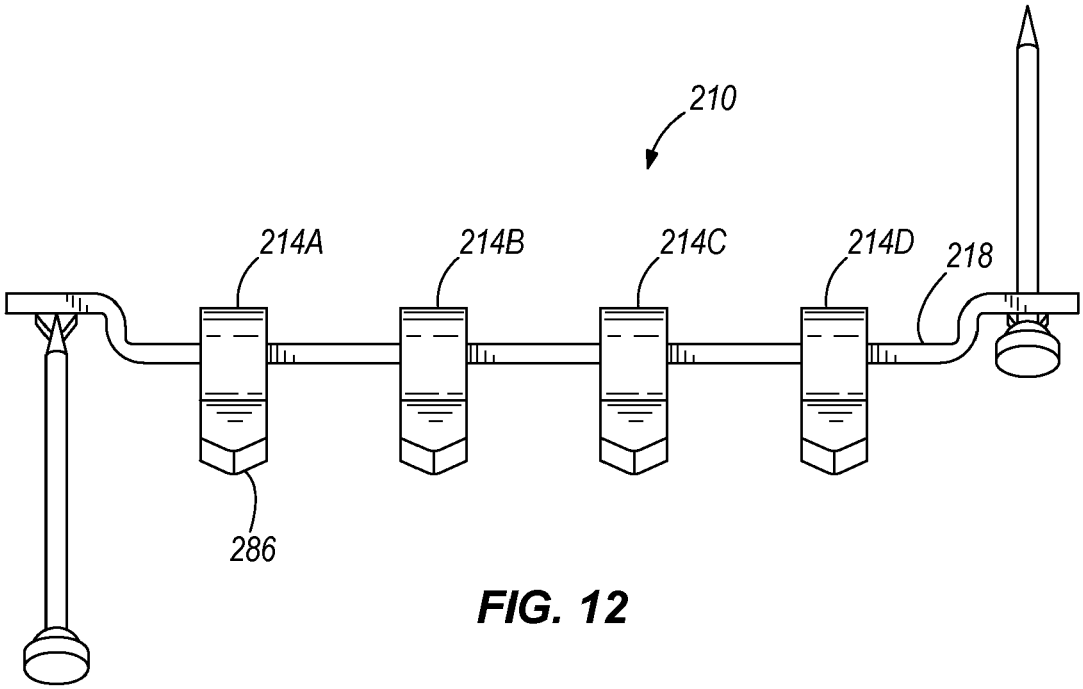
FIG. 12 is a top view of the adjustable hanging device of FIG. 10.
Figure 13:
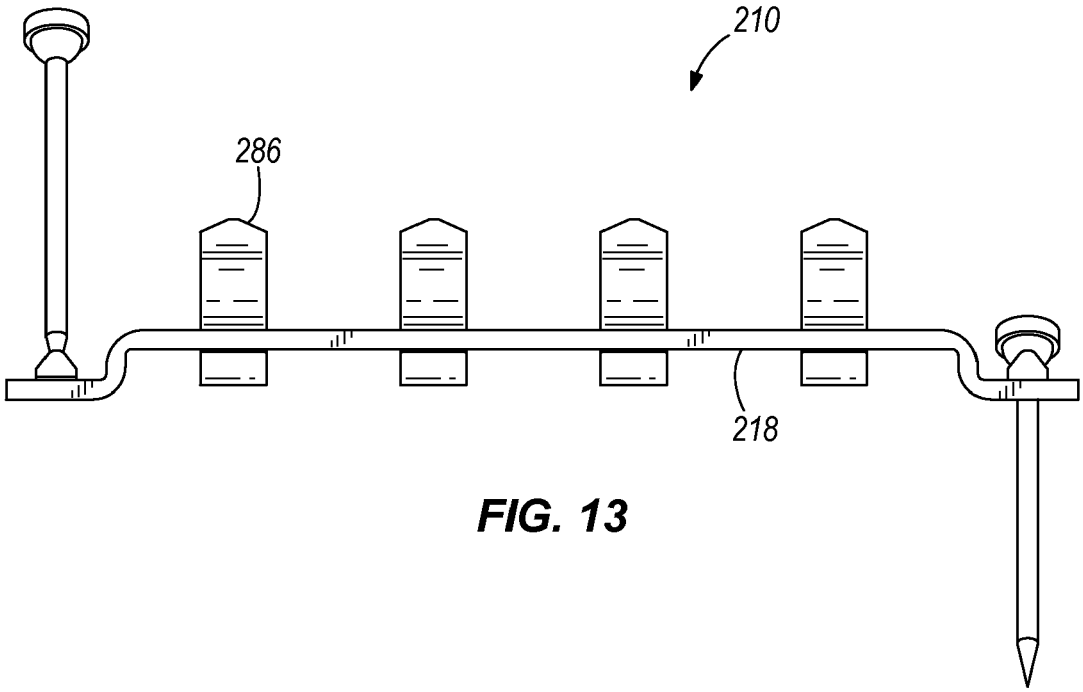
FIG. 13 is a bottom view of the adjustable hanging device of FIG. 10.
Figure 15:
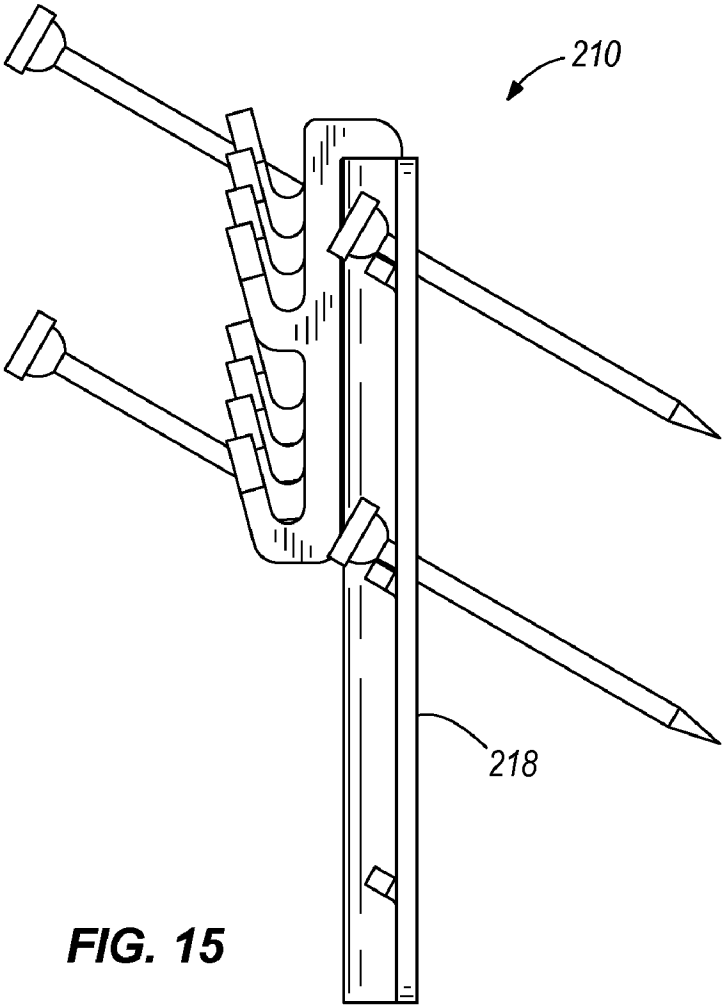
FIG. 15 is a right side view of the adjustable hanging device of FIG. 10.
Figure 14:
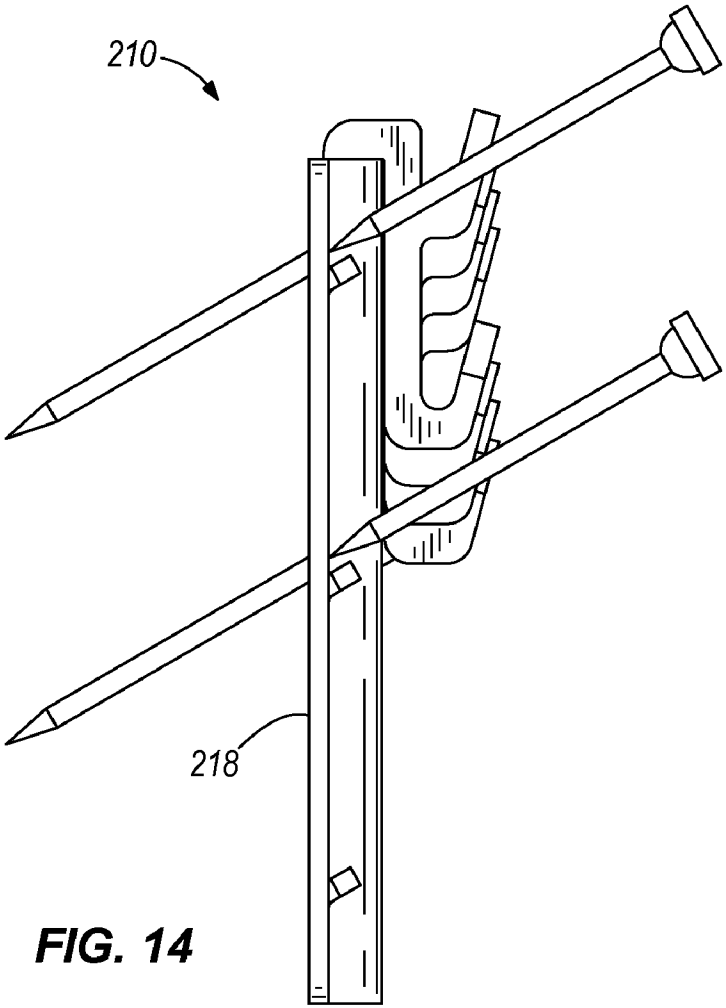
FIG. 14 is a left side view of the adjustable hanging device of FIG. 10.

The object to be hung is carried on a hook member 114 that is attachable to a grid member or "cleat" 118. The grid member 118 can be mounted to a support surface, such as a wall, using fasteners 122 (e.g., nails, screws, etc.) that pass through holes 126 provided in the upper corners of the grid member 118. The hook member 114 includes a hooked portion 140, a first vertical portion 144 and a second vertical portion 148. The first vertical portion 144 and the second vertical portion 148 define a slot 152 therebetween. The slot 152 is adapted to receive a track member 130 for mounting the hook member 114 to the grid member 118. As shown in FIG. 9, the second vertical portion 148 can have sufficient length to engage the track member 130 that is received in the slot 152 as well as the lower adjacent track member 130. The hook member 114 hangs on the given track 130 and is additionally braced by the next lower track 130.

As also shown in FIGS. 5-9, the holes 126 for receiving the fasteners 122 can be vertically elongated. The shape of the hole 126 is therefore adapted for receiving the fastener 122 at an acute angle to the support surface while permitting the grid member 118 to be mounted flush to the support surface.

FIGS. 10-15 illustrate an alternate embodiment of an adjustable hanging device 210 according to the present invention. The hanging device 210 shown in FIGS. 10-15 is similar in many ways to the illustrated embodiments of FIGS. 1-9 described above. Accordingly, with the exception of mutually inconsistent features and elements between the embodiment of FIGS. 10-15 and the embodiments of FIGS. 1-9, reference is hereby made to the description above accompanying the embodiments of FIGS. 1-9 for a more complete description of the features and elements (and the alternatives to the features and elements) of the embodiment of FIGS. 10-15. Features and elements in the embodiment of FIGS. 10-15 corresponding to features and elements in the embodiments of FIGS. 1-9 are numbered in the 200 series.

The adjustable hanging device 210 includes a number of differently sized hook members 214A, 214B, 214C, 214D, each of which is supportable on the grid member 218 and is moveable along each of the tracks 230. Each of the hook members 214A, 214B, 214C, 214D can include two or more contoured portions 286 for engaging and supporting a picture. The contoured portions 286 can be positioned at different relative locations along each of the hook members 214A, 214B, 214C, 214D. Alternatively or in addition, two of the contoured portions 286 of one of the hook members (e.g., hook member 214A) can be spaced a first distance apart from an adjacent contoured portion 286, while the contoured portions 286 of another hook member (e.g., 214B) can be spaced apart a second, different distance. The inclusion of the a number of different hooks 214A, 214B, 214C, 214D and also the inclusion of additional contoured portions 286 on each of the hooks 214A, 214B, 214C, 214D provides a number of different mounting orientations for a picture without requiring an installer to reposition the grid member 218 or to create additional holes in the wall to which the hanging device 210 is mounted.

Once the grid member 18 is mounted to the support surface, the hook member 14 carrying the object may be adjustably positioned on the grid member 18. The hook member 14 is positioned on one of several vertically-spaced tracks 30 of the grid member 18. The hook member 14 hangs on the given track 30 and is additionally braced by the next lower track 30. Once positioned on one of the tracks 30, the hook member 14 is also horizontally adjustable along the track 30 between two opposite ends 34, 38 of the given track 30. Once in a desired position, both vertically and horizontally on the grid member 18, the hook member 14 (and the picture frame or other object) can easily be reoriented with respect to the support structure without removing or replacing the grid member 18. This process can be repeated with additional hook members 14 and objects on the same grid member 18 or an additional grid member 18 to create a vertically and horizontally adjustable array of objects, which can be re-aligned, interchanged, or adjusted horizontally and vertically in any desirable way without remounting the grid member(s) 18 on the support surface, without modifying any part of the object, the hook member 14, or the grid member 18, and without adding any additional components to the object or the hanging device 10.

Thus, the invention provides, among other things, a device and method for hanging an object on a support surface, the device allowing simple positional adjustment of the object relative to the support surface without modification to the object or remounting any portion of the device on the support surface.

What is claimed is:

1. An adjustable hanging device for securing an object to a wall, the adjustable hanging device comprising:

a frame defining a plurality of substantially parallel slots and bars, and being securable to a wall; and a hook including a vertical body portion having an outwardly extending hooked portion for receiving and supporting objects, and a second portion substantially parallel to the body portion and extending over a bar and across at least two bars;

wherein the hook is selectively moveable along each of the plurality of slots in a sliding direction to adjust an orientation of the object relative to the wall, each of the plurality of slots having a closed end to prevent the hook from disengaging the frame while moving in the sliding direction.

2. The adjustable hanging device of claim 1, wherein each of the plurality of slots have a pair of spaced apart closed ends to prevent the hook from disengaging the frame while moving in the sliding direction and in a direction opposite to the sliding direction.

3. The adjustable hanging device of claim 1, wherein the hook includes a plurality of spaced apart contoured portions, each of the contoured portions being engageable with the object to support the object on the frame.

4. The adjustable hanging device of claim 3, wherein the hook is a first hook, and further comprising a second hook including a plurality of spaced apart contoured portions, each of the engageable with the object to support the object on the frame, the plurality of spaced apart contoured portions of the first hook being spaced differently from the contoured portions of the second hook.

5. The adjustable hanging device of claim 1, wherein pairs of the plurality of substantially parallel bars at least partially defining the plurality of parallel slots, and wherein, when the hook is supported on the frame, the hook extends around at least three sides of at least one of the plurality of bars.

6. The adjustable hanging device of claim 1, wherein the hook is a first hook having a first end for selectively engaging the frame and a second end for engaging the object, and further comprising a second hook including a first end for selectively engaging the frame and a second end for engaging the object, the first and second ends of the first hook being spaced differently from the first and second ends of the second hook.

* * * * *